US009955732B2

(12) United States Patent
Lin

(10) Patent No.: US 9,955,732 B2
(45) Date of Patent: May 1, 2018

(54) LIQUID STORAGE DEVICE FOR COTTON-FREE ELECTRONIC CIGARETTE

(71) Applicant: Guangrong Lin, Guangdong (CN)

(72) Inventor: Guangrong Lin, Guangdong (CN)

( * ) Notice: Subject to any disclaimer, the term of this patent is extended or adjusted under 35 U.S.C. 154(b) by 340 days.

(21) Appl. No.: 14/766,455

(22) PCT Filed: May 26, 2014

(86) PCT No.: PCT/CN2014/078416

§ 371 (c)(1),
(2) Date: Aug. 6, 2015

(87) PCT Pub. No.: WO2015/081668

PCT Pub. Date: Jun. 11, 2015

(65) Prior Publication Data

US 2016/0270444 A1 Sep. 22, 2016

(30) Foreign Application Priority Data

Dec. 4, 2013 (CN) ..... 2013 2 0785583 U

(51) Int. Cl.
*A24F 47/00* (2006.01)
*B65D 1/42* (2006.01)
*B65D 23/04* (2006.01)

(52) U.S. Cl.
CPC ..... *A24F 47/008* (2013.01); *B65D 1/42* (2013.01); *B65D 23/04* (2013.01)

(58) Field of Classification Search
CPC ..... A24F 47/00; A24F 47/008; B65D 1/42; B65D 23/04

(Continued)

(56) References Cited

U.S. PATENT DOCUMENTS

2011/0265806 A1* 11/2011 Alarcon ..... A24F 47/00 131/273
2013/0192616 A1* 8/2013 Tucker ..... H01C 17/00 131/328

(Continued)

FOREIGN PATENT DOCUMENTS

CN 201332678 Y 10/2009
CN 201640457 U * 11/2010

OTHER PUBLICATIONS

International Search Report of PCT Patent Application No. PCT/CN2014/078416 dated Aug. 29, 2014.

*Primary Examiner* — Tulsidas C Patel
*Assistant Examiner* — Travis Chambers

(57) ABSTRACT

The present invention relates to a liquid storage device for a cotton-free electronic cigarette, comprising a liquid storage cup for storing cigarette liquid, and a liquid percolation piece having a plurality of liquid percolation holes; wherein the liquid storage cup has a cylindrical shape, an inner wall of a liquid outlet end of the liquid storage cup is provided with at least two locking members, the liquid percolation piece has a circular edge which engages with an internal circumferential surface of the liquid outlet end of the liquid storage cup, the liquid percolation piece is inserted into the liquid outlet end of the liquid storage cup and is passed through the at least two locking members to be locked. The liquid storage device ensures the smooth supply of cigarette liquid and prevents cigarette liquid leakage. The liquid storage device of the present invention can be easily and efficiently assembled.

5 Claims, 3 Drawing Sheets

(58) Field of Classification Search
USPC ..... 131/329
See application file for complete search history.

(56) References Cited

U.S. PATENT DOCUMENTS

2015/0059787 A1* 3/2015 Qiu ..... H05B 3/14
131/329
2015/0223521 A1* 8/2015 Menting ..... A24F 47/008
131/273

* cited by examiner

LIQUID STORAGE DEVICE FOR COTTON-FREE ELECTRONIC CIGARETTE

FIELD OF THE INVENTION

The present invention relates to a cotton-free electronic cigarette, especially relates to a liquid storage device for the cotton-free electronic cigarette.

BACKGROUND OF THE INVENTION

With the development of electronic cigarettes, various electronic cigarettes with different structures have been invented. Among these electronic cigarettes, a cotton-free electronic cigarette is a highly popular electronic cigarette right now. The cotton-free electronic cigarette has fewer components than conventional electronic cigarettes, so the assembly of the components of the cotton-free electronic cigarette is easy and the assembled cotton-free electronic cigarette has a simple structure. The cotton-free electronic cigarette uses a liquid percolation piece to directly absorb cigarette liquid stored in a liquid storage cup, so the way of fixing the liquid percolation piece and the liquid storage cup is significant to the prevention of liquid leakage and to the smooth supply of cigarette liquid.

SUMMARY OF THE INVENTION

In order to overcome the shortcomings of existing electronic cigarettes, the present invention aims to provide a liquid storage device for a cotton-free electronic cigarette. The liquid storage device has a simple structure, a strong connection and an easy assembly method.

The technical solution of the present invention is a liquid storage device for a cotton-free electronic cigarette, comprising a liquid storage cup for storing cigarette liquid, and a liquid percolation piece having a plurality of liquid percolation holes; wherein the liquid storage cup has a cylindrical shape, an inner wall of a liquid outlet end of the liquid storage cup is provided with at least two locking members, the liquid percolation piece has a circular edge which engages with an internal circumferential surface of the liquid outlet end of the liquid storage cup, the liquid percolation piece is inserted into the liquid outlet end of the liquid storage cup and is passed through the at least two locking members to be locked.

A plurality of longitudinally-disposed supporting ribs are inwardly protruded from an inner wall of a liquid storage part of the liquid storage cup, the liquid percolation piece is pressed by the locking members to be locked on a top of the supporting ribs.

The locking members are a plurality of locking members that are uniformly distributed along a circumference of the inner wall of the liquid outlet end of the liquid storage cup.

The liquid percolation piece is made of heat resistant plastic, heat resistant fiber, or metal.

The liquid percolation piece abuts against a filter piece; a heating element of a vaporization assembly is close to the liquid percolation piece and the filter piece.

A lateral airflow opening that allows for the passage of vaporized cigarette liquid is opened in a wall of the liquid outlet end of the liquid storage cup.

In the present invention, the liquid percolation piece is snap-fitted into the liquid storage cup, which prevents the leakage of cigarette liquid that may result from a liquid percolation piece being deflected during the assembly process. The structure of the liquid storage device of the present invention not only ensures the smooth supply of cigarette liquid, but also prevents the leakage of cigarette liquid. In addition, the snap-fitted fashion between the liquid percolation piece and the liquid storage cup greatly improves the efficiency of the assembly of the liquid storage device.

DETAILED DESCRIPTION OF ILLUSTRATED EMBODIMENTS

Figure 1:
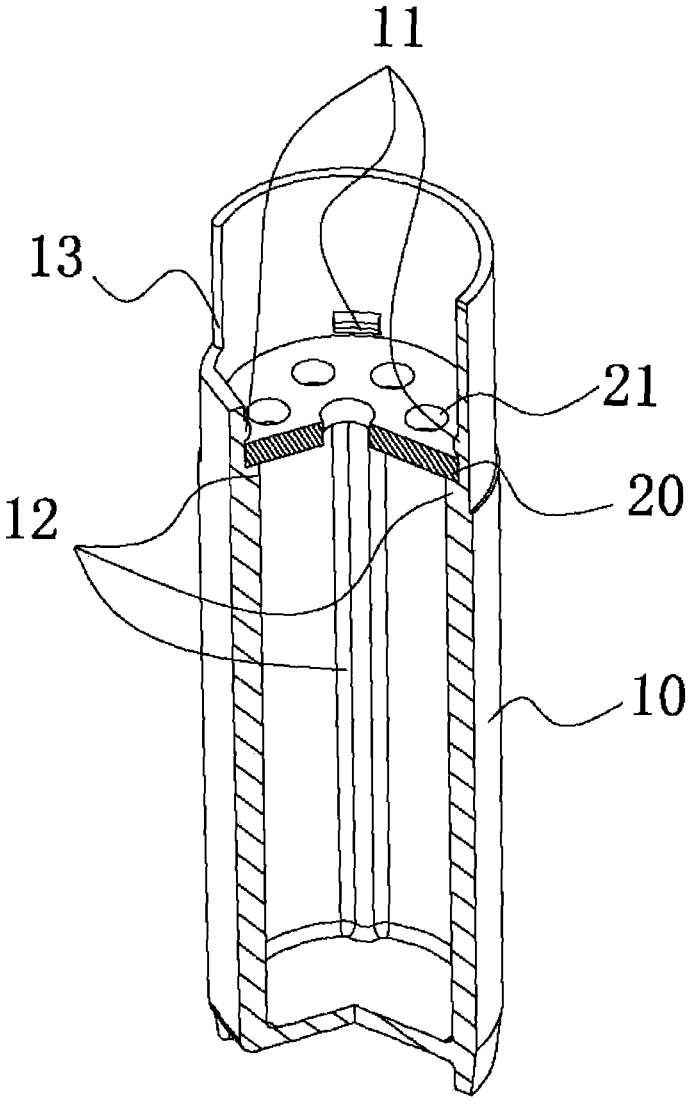
FIG. 1 is a schematic view of an assembled liquid storage device of the present invention, the liquid storage device being partially sectioned.
Figure 2:
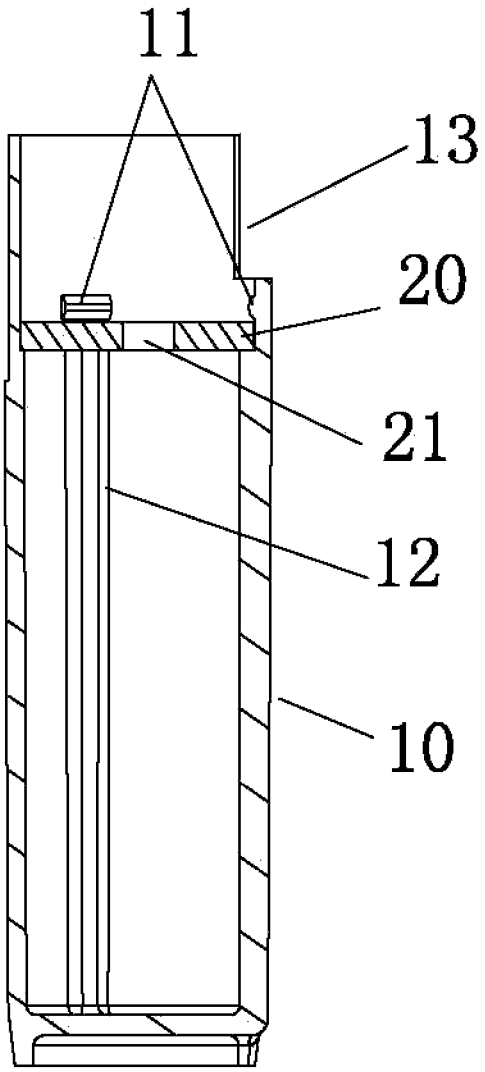
FIG. 2 is a cross-sectional view of an assembled liquid storage device of the present invention.
Figure 3:
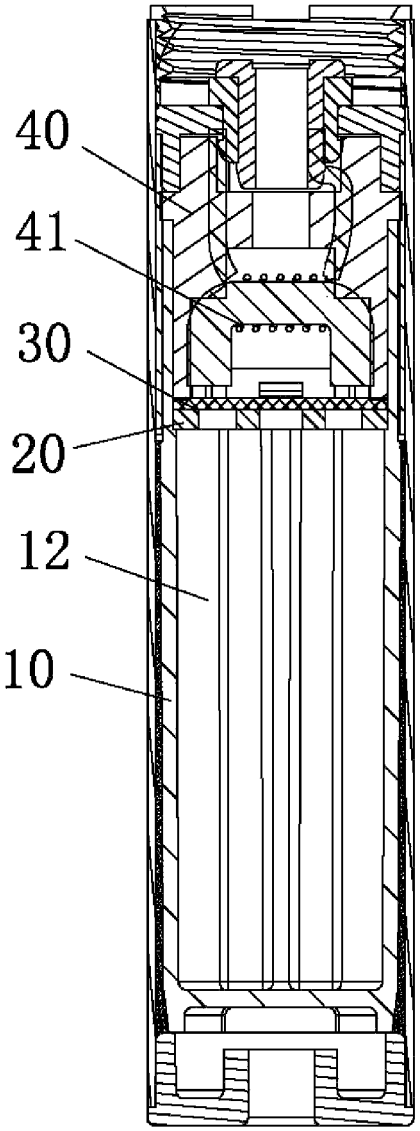
FIG. 3 is a cross-sectional view of a vaporizer of an electronic cigarette, the vaporizer being equipped with a liquid storage device of the present invention.

As shown in FIGS. 1-3, a liquid storage device for a cotton-free electronic cigarette comprises a liquid storage cup 10 for storing cigarette liquid, and a liquid percolation piece 20 having a plurality of liquid percolation holes 21; wherein the liquid storage cup 10 has a cylindrical shape, an inner wall of a liquid outlet end of the liquid storage cup 10 is provided with at least two locking members 11, the liquid percolation piece 20 has a circular edge which engages with an internal circumferential surface of the liquid outlet end of the liquid storage cup 10, the liquid percolation piece 20 is inserted into the liquid outlet end of the liquid storage cup 10 and is passed through the at least two locking members 11 to be locked.

A plurality of longitudinally-disposed supporting ribs 12 are inwardly protruded from an inner wall of a liquid storage part of the liquid storage cup 10, the liquid percolation piece 20 is pressed by the locking members 11 to be locked on a top of the supporting ribs 12.

The locking members 11 are a plurality of locking members 11 that are uniformly distributed along a circumference of the inner wall of the liquid outlet end of the liquid storage cup 10.

The liquid percolation piece 20 is made of heat resistant plastic, heat resistant fiber, or metal.

The liquid percolation piece 20 abuts against a filter piece 30; a heating element 41 of a vaporization assembly 40 is close to the liquid percolation piece 20 and the filter piece 30.

A lateral airflow opening 13 that allows for the passage of vaporized cigarette liquid is opened in a wall of the liquid outlet end of the liquid storage cup 10.

In the preset invention, the liquid percolation piece 20 is snap-fitted by the locking member 11. The locking member 11 is made of an elastically deformable material. When assembling the liquid storage device, the liquid percolation piece 20 squeezes the locking member 11 to make the locking member 11 deformed, such that the liquid percolation piece 20 is passed through the locking member 11. After the liquid percolation piece 20 is passed through the locking member 11, the top surface and the bottom surface of the liquid percolation piece 20 are respectively tightly pressed by the locking member 11 and the top of the supporting rib 12, therefore, the engagement between the liquid percolation piece 20 and the liquid storage cup 10 is very stable and firm even if the cotton-free electronic cigarette is inclined or shaken. The structure of the liquid storage device of the present invention not only ensures the smooth supply of cigarette liquid, but also prevents the leakage of cigarette liquid. In addition, the snap-fitted fashion between the liquid percolation piece and the liquid storage cup greatly improves the efficiency of the assembly of the liquid storage device.

All the above are the preferred embodiments of the present invention, and the invention is intended to cover various modifications and equivalent arrangements included within the scope of the invention.

What is claimed is:

1. A liquid storage device for a cotton-free electronic cigarette, comprising a liquid storage cup for storing cigarette liquid, and a liquid percolation piece having a plurality of liquid percolation holes;

the liquid storage cup has a cylindrical shape, an inner wall of a liquid outlet end of the liquid storage cup is provided with at least two locking members, the liquid percolation piece has a circular edge which engages with an internal circumferential surface of the liquid outlet end of the liquid storage cup, the liquid percolation piece is inserted into the liquid outlet end of the liquid storage cup and is passed through the at least two locking members to be locked;

wherein a plurality of longitudinally-disposed supporting ribs are inwardly protruded from an inner wall of a liquid storage part of the liquid storage cup, the liquid percolation piece is pressed by the locking members to be locked on a top of the supporting ribs.

2. The liquid storage device according to claim 1, characterized in that the locking members are a plurality of locking members that are uniformly distributed along a circumference of the inner wall of the liquid outlet end of the liquid storage cup.

3. The liquid storage device according to claim 2, characterized in that the liquid percolation piece is made of heat resistant plastic, heat resistant fiber, or metal.

4. The liquid storage device according to claim 3, characterized in that the liquid percolation piece abuts against a filter piece; a heating element of a vaporization assembly is close to the liquid percolation piece and the filter piece.

5. The liquid storage device according to claim 4, characterized in that a lateral airflow opening that allows for the passage of vaporized cigarette liquid is opened in a wall of the liquid outlet end of the liquid storage cup.

* * * * *